US005832710A

United States Patent [19]

Geerlings

[11] Patent Number: 5,832,710

[45] Date of Patent: Nov. 10, 1998

[54] OPEN-END SPINNING FRAME WITH DIRT REMOVAL DEVICE

[75] Inventor: Barthel Geerlings, Brüggen, Germany

[73] Assignee: W. Schlafhorst AG & Co., Moenchengladbach, Germany

[21] Appl. No.: 758,229

[22] Filed: Nov. 27, 1996

[30] Foreign Application Priority Data

Dec. 1, 1995 [DE] Germany ..... 195 44 839.1

[51] Int. Cl.[6] ..... D01H 11/00

[52] U.S. Cl. ..... 57/301; 57/304; 57/408; 57/411

[58] Field of Search ..... 57/408, 411, 412, 57/301, 304, 406

[56] References Cited

U.S. PATENT DOCUMENTS

| | | | |
|---|---|---|---|
| 3,792,575 | 2/1974 | Doudlebsky et al. | 57/301 |
| 4,009,562 | 3/1977 | Stalder | 57/301 |
| 4,142,356 | 3/1979 | Husges et al. | 57/301 |
| 4,204,393 | 5/1980 | Miyazaki et al. | 57/301 |
| 4,249,370 | 2/1981 | Vecera et al. | 57/301 |
| 4,483,135 | 11/1984 | Kurushima et al. | 57/301 |
| 4,505,101 | 3/1985 | Kurushima et al. | 57/301 |
| 4,852,340 | 8/1989 | Kotrba et al. | 57/301 |
| 5,454,219 | 10/1995 | Raasch | 57/301 X |
| 5,481,862 | 1/1996 | Wassenhoven | 57/301 |

FOREIGN PATENT DOCUMENTS

| | | | |
|---|---|---|---|
| 24 55 530 A1 | 6/1975 | Germany . | |
| 26 48 708 A1 | 5/1978 | Germany . | |
| 38 04 277 C2 | 1/1992 | Germany . | |
| 4310810 | 10/1994 | Germany | 57/301 |

*Primary Examiner*—William Stryjewski
*Attorney, Agent, or Firm*—Kennedy, Covington, Lobdell & Hickman, LLP

[57] ABSTRACT

An open-end spinning frame having a sliver opening device wherein the housing for the opening roller has a dirt outlet opening for removing dirt particles from the housing as well as for admitting air flow to assist in the fiber opening process. In accordance with the invention, an air guidance system is arranged in the area of a wall of the housing bordering the dirt outlet opening rearwardly with respect to the direction of rotation of the opening roller which serves to ensure dependable removal of problematic dirt particles, i.e. dirt particles which have a relatively large surface in respect to a relatively small mass.

10 Claims, 4 Drawing Sheets

OPEN-END SPINNING FRAME WITH DIRT REMOVAL DEVICE

FIELD OF THE INVENTION

The present invention relates to an open-end spinning frame with a sliver opening device, and more particularly to an open-end spinning frame whose sliver opening device has an opening roller housing with a dirt outlet opening for removing dirt particles from the housing and/or for admitting an air flow.

BACKGROUND OF THE INVENTION

Open-end spinning frames of the basic type described above are known, for example, from German Patent Publication 38 04 277 C2.

In such an open-end spinning frame a sliver introduced between a sliver drawn-in roller and a feeding trough is separated into individual fibers by means of an opening roller rotating at a relatively high rotational speed (rpm). In the course of this process, dirt particles and fibers are released from the fibers to the greatest possible degree. The opening roller transports both constituents into the area of a dirt outlet opening. During this transport, the fibers as well as the dirt particles are accelerated in a very short period of time to almost the rotational speed of the opening roller by an air flow rotating along with the opening roller. In the process, because of the action of centrifugal force, the individual constituent components, i.e. the fibers and dirt/debris particles, have a tendency to leave the circular orbit tangentially as soon as the mechanical guidance imposed by the surrounding wall elements of the housing is interrupted, such as is the case in the area of the dirt outlet opening of the opening roller housing.

To prevent spinnable fibers from also becoming detached from the opening roller in the area of the dirt outlet opening, the dirt outlet opening is designed to also serve as an aspiration opening for entry of an air flow into the opening roller housing. This air flow is directed onto the opening roller to act as a pneumatic guide to maintain the fibers on the opening roller due to their relatively large specific surface area in comparison with their relatively low mass. The dirt particles, which have clearly greater kinetic energy because of their greater mass, overcome this air flow and are hurled away tangentially.

In the device known from the aforementioned German Patent Publication DE 38 04 277 C2, the area of the dirt outlet opening is divided into an air feeding conduit, located forwardly in the direction of rotation of the opening roller, and a dirt outlet conduit, located in following or rearward disposition relative to the air feeding conduit. The air feeding conduit has an air flow regulating element which allows for adjustment of the ventilating conditions in relation to the degree of soiling of the slivers to be processed.

While these open end spinning devices have been reasonably effective for removing heavier debris particles, i.e., having a relatively greater mass than the fibers, it has not heretofore been possible to overcome the particular problem of removing dirt particles which have a relatively small mass in comparison to their surface area, for example neps to which fibers still tend to adhere.

Such relatively light dirt particles with a large surface area are combed out of the fibers by the opening roller and tend to leave the opening roller housing mostly in the rearward area of the dirt outlet opening or are hurled against the rear bordering wall of the dirt outlet opening. However, since the kinetic energy of such dirt particles is low, they are often substantially slowed by the air flow present in this area and are conveyed back to the rotating opening roller.

An open end spinning device is known from German Published, Non-Examined Patent Application DE-OS 24 55 530, which has an air baffle in the area of the dirt outlet opening intended to cause a stream of blown air aimed in the direction of rotation of the opening roller to be divided into two components at a wedgeshaped deflecting edge, so that a portion of the blown air stream is deflected in the direction of the rotating flow circulating with the opening roller and the other portion is deflected in the direction of a dirt removal device.

Although the blown air flow can be adjusted both in respect to its direction and in respect to its intensity, this device still has not proven to be effective to overcome the above described problems.

SUMMARY OF THE INVENTION

It is accordingly an object of the present invention to provide an improved dirt removal device for open-end spinning frames of the basic type described above.

This object is attained in accordance with the present invention in an open-end spinning frame comprising a sliver opening device basically having a housing and an opening roller rotatably disposed in the housing for separating an incoming sliver into individual fibers and for releasing debris from the fibers. The housing defines a dirt outlet opening for removal of released debris from the housing and for admitting an air flow into the housing and the housing includes a wall bordering a side of the dirt outlet opening rearwardly relative to the direction of rotation of the opening roller. According to the present invention, an air guidance means is arranged within the dirt outlet opening in the area of the rearward bordering wall to assist in the removal of problematic debris of the type having a relatively large surface area in relation to a relatively small mass. In particular, the air guidance means defines a dirt removal conduit extending along the bordering wall and means opening into the dirt removal conduit for admitting an auxiliary flow of air thereinto, e.g. an auxiliary air flow duct. The dirt removal conduit has a first air flow section and a second air flow section extending oppositely from the auxiliary air flow means, and the dirt removal conduit and the auxiliary air flow means cooperate to divide the auxiliary air upon entering the dirt removal conduit to flow oppositely into and through the first and second air flow sections The device of the present invention has the advantage that the critical zone of the dirt outlet opening located in the area of the rearward bordering wall is configured by means of the described air guidance system to assure a defined guidance in this area of an air flow aspirated into the opening roller housing.

By positioning the dirt removal conduit in the area of the rearward bordering wall of the opening roller housing and causing the air flow introduced through the auxiliary air flow means to be divided upon entering the dirt removal conduit into two opposite flow components, one flow component is effectively directed onto the rotating opening roller to act in this case as a form of pneumatic guide to prevent the lighter individual fibers which have been combed out of the incoming sliver from being released from the opening roller prematurely in the area of the dirt outlet opening, while the oppositely directed flow component serves to assure that the released dirt particles which reach the area of the dirt removal conduit are reliably removed.

In the preferred embodiment, the first air flow section of the dirt removal conduit comprises between approximately one-fourth to approximately one-third of the total length of the dirt removal conduit, which additionally assures that appropriate flow conditions prevail predominantly along the dirt removal conduit to effect the immediate removal of all dirt particles which have entered therein, including especially relatively light dirt particles.

It is further preferred that the auxiliary air flow means is arranged to cause a suction air flow to prevail therein in the direction toward the dirt removal conduit. In turn, the dirt removal conduit and the auxiliary air flow means are operative to divide the suction air flow upon entry into the dirt removal conduit into a first flow component directed through the first air flow section toward the opening roller and a second opposite flow component directed through the second air flow section away from the opening roller. This arrangement is designed to particularly assure that defined flow conditions prevail within the dirt removal conduit, such that in the conduit section located between the mouth of the auxiliary air duct and the outlet of the dirt removal conduit there is always an air flow directed toward the conduit outlet, which makes sure that the dirt particles which have entered this conduit section are reliably removed, regardless of their mass and surface.

Alternative embodiments of air guidance systems can be used in the critical area of the dirt outlet opening. In one such embodiment, an auxiliary air flow duct which is in direct contact with the atmosphere is integrated into the rearward bordering wall of the opening roller housing. Alternatively, an auxiliary air duct may be defined to open into the dirt removal conduit from a location forwardly thereof. Another embodiment utilizes both a forwardly located auxiliary air duct and an air duct connected to atmosphere integrated into the rearward bordering wall of the housing, each of which opens into the dirt removal conduit. These embodiments of an air guidance system can be particularly advantageous in connection with fiber materials which are difficult to process.

Further details of the invention ensue from the exemplary embodiments described more fully below with reference to the drawings.

DETAILED DESCRIPTION OF THE PREFERRED EMBODIMENTS

Figure 1:
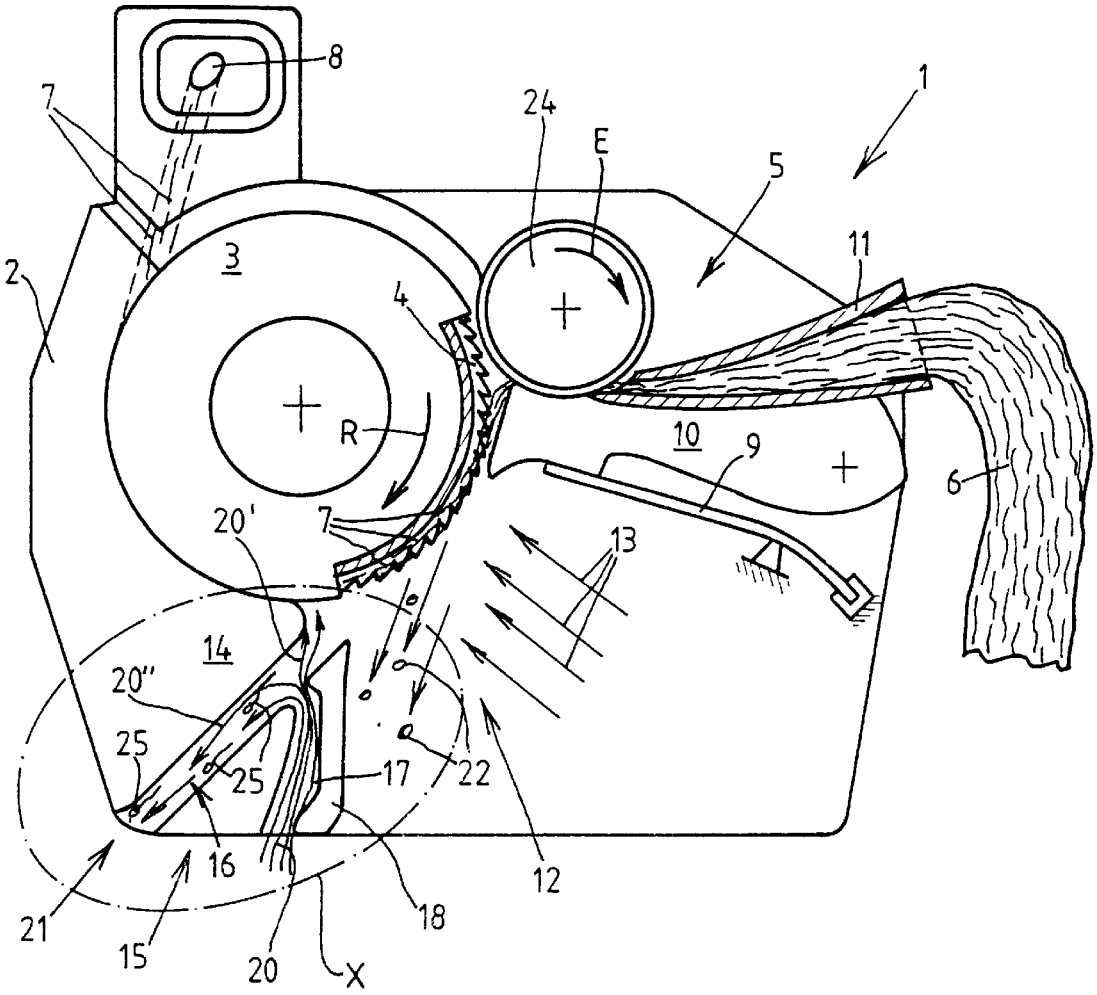
FIG. 1 is a schematic diagram, partially in side elevation and partially in cross-section, of a sliver opening device for an open end spinning unit with an air guidance system in accordance with the present invention located in the area of the dirt outlet opening of the opening housing.

A sliver opening device 1 of the basic type known in the textile yarn spinning industry is represented in FIG. 1. Such sliver opening devices essentially have an opening roller housing 2, in which a opening roller 3 is rotatably supported and driven at a relatively high rotational speed (rpm) in the direction R. As is customary, the opening roller 3 has a set of toothed annular disks 4, fixed on the outer circumference of the roller 3 side by side one another spaced by intervening lateral rims. The toothed disk set 4 combs a sliver 6 delivered by a feed device 5 into individual fibers 7, which are then conveyed to an open-end spinning unit (not shown) through a fiber guide conduit 8.

In this case, the feed device 5 consists of a sliver draw-in roller 24 rotating in a direction E and a feeding trough 10, which can be placed against the sliver draw-in roller 24. The sliver draw-in roller rotates at a relatively low rotational speed (rpm) in a known manner. Preferably the feeding trough 10 forms a structural unit with a sliver condenser 11, which securely guides the sliver 6 into a clamping area between the sliver draw-in roller and the feeding trough. The opening roller housing 2, which is closed over a large portion of the circumference of the roller 3, has a dirt outlet opening 12 adjoining the sliver feed device 5.

An air guidance system 15 has been installed within the dirt outlet opening 12 in the area adjacent the bordering wall 14 of the housing 2 located at the rearward side of the dirt outlet opening 12, as viewed in the direction of rotation of the opening roller 3. As shown in FIG. 1, this air guidance system 15 preferably defines a dirt removal conduit 16 extending parallel with the bordering wall 14 and an auxiliary air duct 17 defined by a deflecting wall 18 to open into the dirt removal conduit 16, preferably in the upper third of the lengthwise extent of the dirt removal conduit 16, as viewed in the direction of dirt flow therealong.

Figure 2:
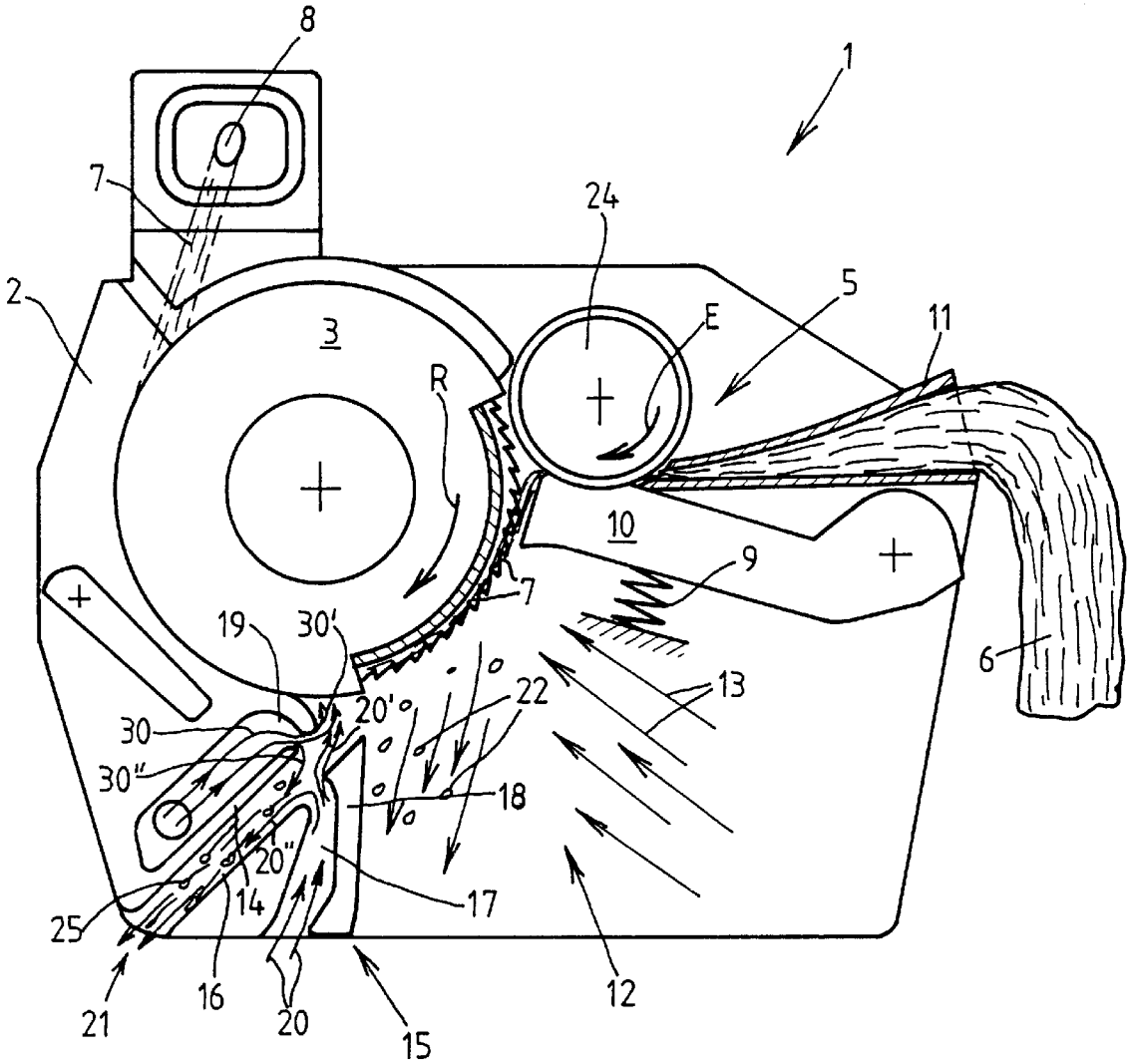
FIG. 2 shows an alternative embodiment of an air guidance system for a sliver opening device in an open end spinning unit in accordance with the present invention.

A somewhat modified embodiment of the air guidance system 15 is represented in FIG. 2. In this embodiment, a further air connector duct 19 is formed through the bordering wall 14 to extend from an air entrance location directly connected with the atmosphere and to open into the dirt removal conduit 16 in addition to the auxiliary air duct 17.

Figure 3:
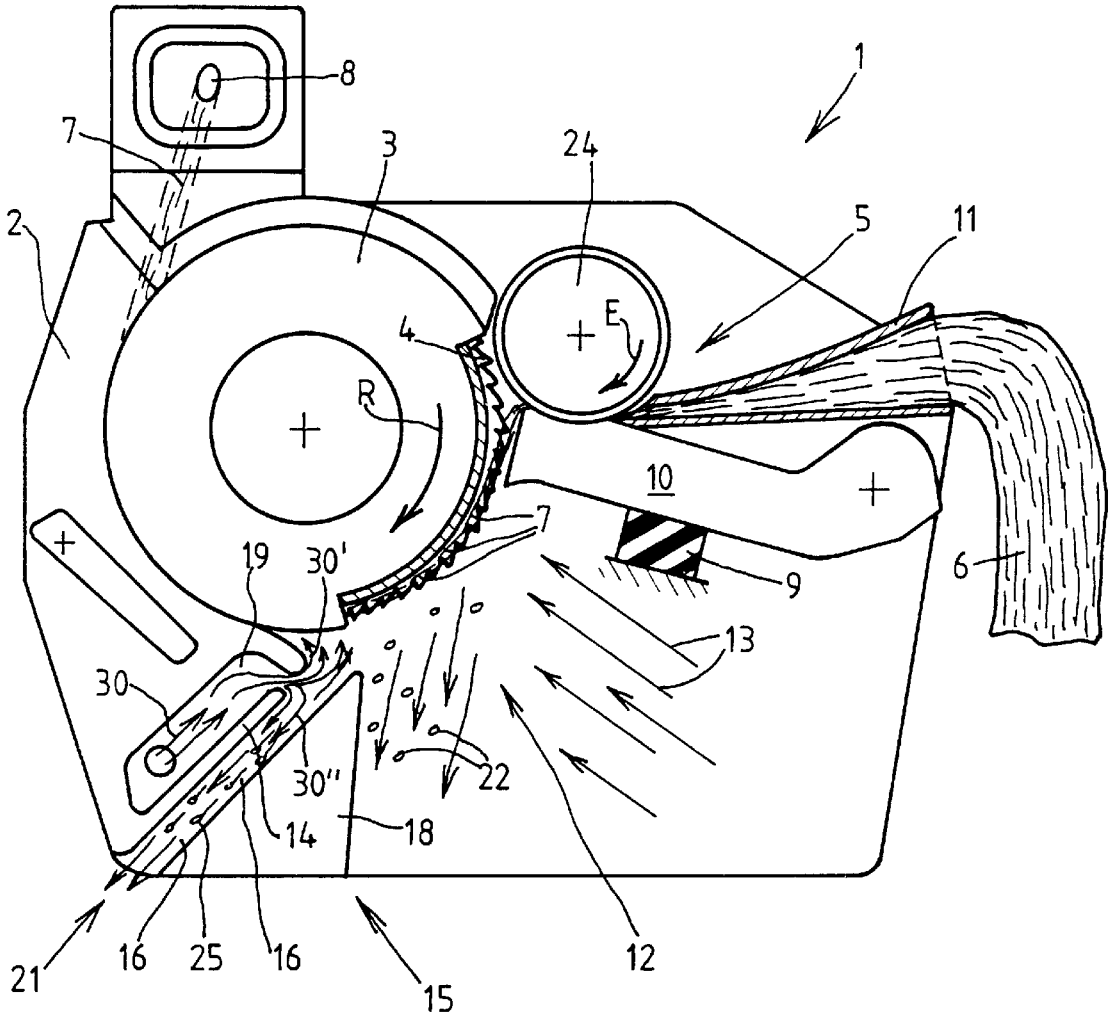
FIG. 3 shows a further embodiment of an air guidance system for a sliver opening device in an open end spinning unit in accordance with the present invention.

A third variant of the air guidance system is represented in FIG. 3. An auxiliary air duct 17, such as is provided in FIGS. 1 and 2, is omitted in this embodiment and only an air connector duct 19, formed into the bordering wall 14 and directly connected with the atmosphere, opens into the dirt removal conduit 16.

Figure 4:
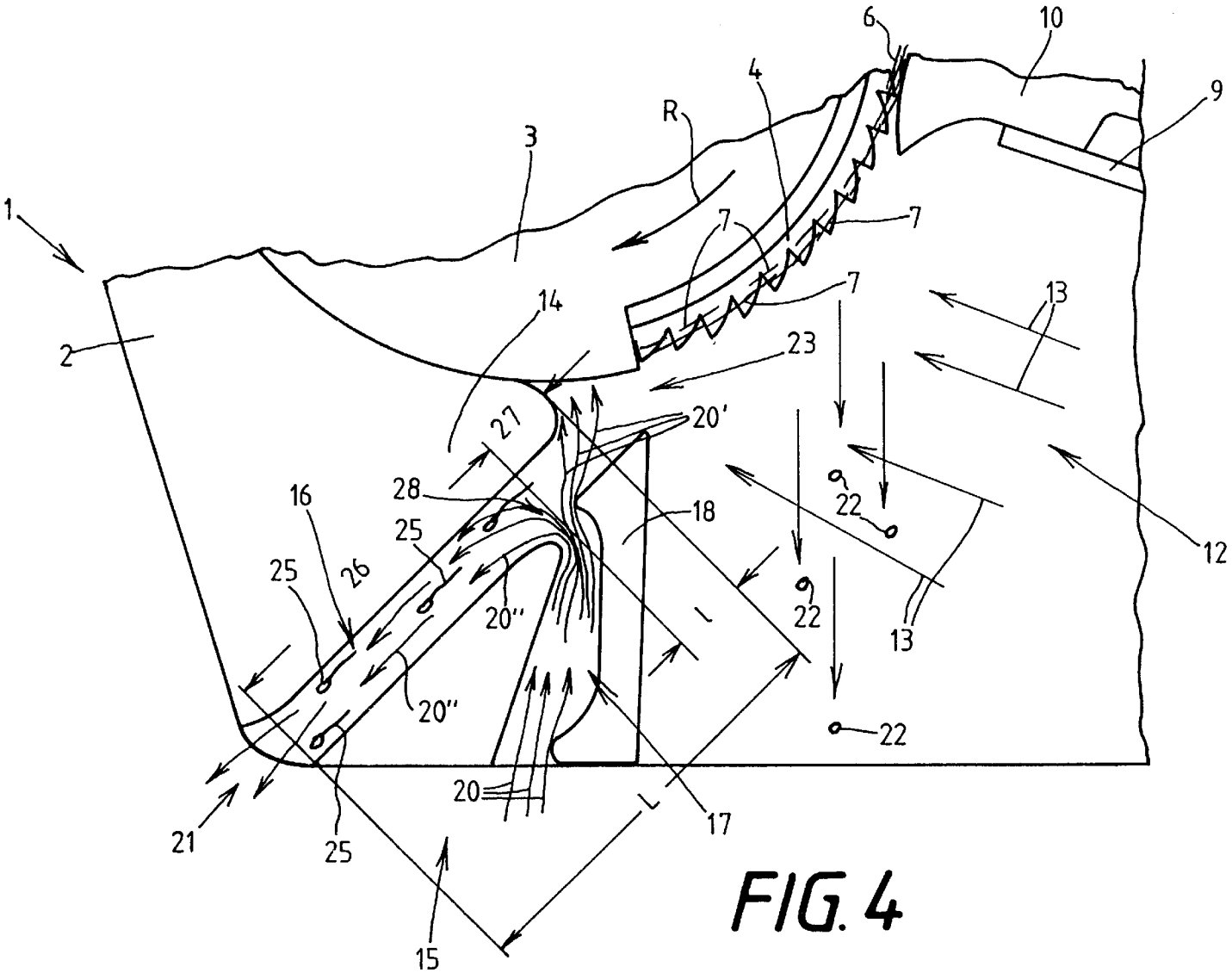
FIG. 4 shows the air guidance system of FIG. 1 on an enlarged scale.

The function of the air guidance system of the present invention may thus be understood. With reference initially to the embodiment of FIG. 1 and the enlargement thereof in FIG. 4, it is known that in the interest of a flawless spinning process it is necessary that an approximately uniform partial pressure should prevail in the rotor housing (not shown) of the open-end spinning unit. Therefore the rotor housing is connected to a vacuum source via appropriate pneumatic lines. The partial pressure prevailing in the rotor housing also is effectively applied to the opening roller housing 2 via the fiber guide conduit 8 which extends from the opening roller housing 2 to deliver opened fibers into the spinning rotor housing. This partial vacuum is additionally reinforced by a rotational flow of air (not indicated) which is caused to circulate with the opening roller 3 in the direction R by virtue of the rotational movement of the opening roller itself and, in turn, causes suction air flows 13 and 20 to be created in the area of the dirt outlet opening 12 and also in the area of the air guidance system 15. These suction air flows 13 and 20 impose a pneumatic guidance force in the area of the dirt outlet opening 12 of the opening roller housing 2, to keep the spinnable individual fibers 7 which were combed out of the sliver 6 by the opening roller 3 fixed on the surface of the opening roller.

While the suction air flow 13 prevails over almost the entire area of the dirt outlet opening 12, the suction air flow 20 only occurs in the area of the air guidance system 15, whereby the partial pressure occurring in the rotor housing initiates a suction air flow 20 through the auxiliary air duct 17, which is then divided into flow components 20' and 20" when the air flow enters the dirt removal conduit 16. The flow component 20' is directed onto the rotating opening roller 3 and becomes a part of the pneumatic guiding air flow, while the flow component 20" is directed into and through the dirt removal conduit 16 to its outlet end 21 and thereby functions as a transport flow for entraining the dirt particles which have entered the conduit 16.

The sliver 6 is fed by means of the feed device 5 to the opening roller 6 whose toothed disk set 4 progressively combs the sliver to produce individualized fibers 7 which are then delivered into and transported through the fiber guide conduit 8 to the aforementioned open-end spinning unit (not shown) in a known manner, where they are spun into a yarn.

In addition to the spinnable individual fibers 7, the relatively high rotational speed (rpm) at which the toothed disk set 4 of the opening roller 3 rotates also serves to comb relatively heavy dirt particles 22 out of the incoming sliver 6, as well as other impurities 25 which are relatively lighter in weight in contrast with their surface area. These impurities 25, for example neps with which fibers are typically adhered, are particularly critical.

As already mentioned above, the opening roller 3 rotating at high rpm accelerates the combed sliver components to essentially the same speed as the rotational speed of the roller in a very short period of time and, in turn, the combed sliver components have the tendency to detach themselves from the toothed disk set under the effect of the centrifugal force thusly imposed. While the spinnable individual fibers, which are very light in weight in relation to their surface area, continue to adhere to the toothed roller surface under the effect of the pneumatic guidance force imposed by the air flows 13, 20, the dirt particles tend to be hurled away tangentially. Because of their inherent kinetic energy, the heavier dirt particles 22 relatively easily overcome the entraining force of the suction air flow 13 prevailing in the area of the dirt outlet opening 12 in the direction of the rotating opening roller, as is known, and are subsequently removed through a pneumatic or mechanical unit disposed underneath the dirt outlet opening 12.

The separation of those lighter weight dirt particles which have a relatively lower mass compared to their surface area is considerably more difficult. Neps with adhering fibers or the like can be considered to be an example of such relatively light dirt particles.

Heretofore, there has existed the danger that such lighter weight dirt particles, upon impact on the rear bordering wall 14 bordering the dirt outlet opening 12 in conventional dirt removal devices, would be decelerated to a stop by the suction air flow 13 prevailing in such area and would then subsequently be entrained and returned onto the rotating opening roller 3.

The critical area of the dirt outlet opening located in the area of the rear bordering wall 14 is controlled by means of the air guidance system 15 of the present invention so as to provide the faultless removal of even the lighter weight dirt particles 25.

These lighter weight dirt particles 25 released from the toothed disk set 4 as a rule have sufficient kinetic energy to overcome the relatively weak flow component 20' of the suction air flow 20 prevailing at the conduit outlet 23 of the dirt removal conduit 16 and therefore centrifugally travel into the dirt removal conduit 16 beyond the mouth 28 of the auxiliary air duct 17. The flow component 20" directed toward the conduit outlet 21 prevails in this area 26 and immediately entrains these lighter dirt particles 25 to convey them in the direction toward the outlet 21 of the dirt removal conduit 16, where the particles may be removed in a known manner.

In the alternative embodiment of the air guidance system 15 of the present invention shown in FIG. 2, the additional air connector duct 19 opening to the dirt removal conduit 16 is directly connected with the atmosphere and the mouth of the air connector duct 19 is integrated into the rear bordering wall 14 of the dirt outlet opening 12, thereby to provide a supplemental suction air flow in addition to that of the auxiliary air duct 17. The suction air flow 30 exiting the mouth of the air connector duct 19 is divided into different flow components 30' and 30", similar to the suction air flow 20. In this case, the flow component 30' is directed onto the rotating opening roller 3 to become part of the pneumatic fiber guiding airflow force, while the flow component 30" is directed as a debris transporting air flow through the dirt removal conduit 16 toward the conduit outlet 21 thereof.

In the further embodiment of FIG. 3, the air guidance system 15 has only the suction air connector duct 19 combined with the dirt removal conduit 16. As in the exemplary embodiment of FIG. 2, the air connector duct 19 is integrated into the rear bordering wall 14 of the dirt outlet opening 12 and is connected to the atmosphere, whereby the suction air flow 30 entering the dirt removal conduit 16 from the air connector duct 19 is divided into the flow components 30' and 30". Hereagain, the flow component 30' is directed onto the opening roller 3 to become a part of the pneumatic fiber guiding air flow therealong, while the flow component 30" passes through the dirt removal conduit 16 to aid in effecting the removal of the dirt particles 25 entering the dirt removal conduit 16.

As is known, the dirt removal in the opening roller housing of an open-end spinning frame constitutes an important element in optimizing the processing and spinning of fiber materials. The opening and dirt removal components comprise a very sensitive device which reacts delicately to flow changes. Even small modifications of the dirt removal arrangement affect the result not only in respect to the amount of dirt removed, but also the dirt content of the yarn ultimately spun as a whole.

The air guidance system in accordance with the present invention as a whole represents an advantageous and improved device, in comparison to the prior art, which makes it possible to assuredly remove even problematical dirt particles without any negative effects on the flow conditions in the area of the dirt outlet opening.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. An open-end spinning frame having a sliver opening device comprising:

a housing defining an opening roller area and a dirt fallout chamber disposed therebelow and opening into said opening roller area, an opening roller rotatably disposed in said opening roller area for separating an incoming sliver into individual fibers and for releasing debris from the sliver into said dirt fallout chamber, rotation of said opening roller creating a first air flow in said opening roller area, a fiber guide conduit opening into said opening roller area for receiving opened fibers by applying a suction to said opening roller area to create a second air flow, said first air flow and said second air flow creating together an air flow in said dirt fallout chamber towards said fiber guide conduit through said opening roller area, a dirt removal conduit opening into said opening roller area between said fiber guide conduit opening and said dirt fallout chamber opening, and an auxiliary air duct opening into said dirt removal conduit at a juncture spaced from said opening of said dirt removal conduit into said opening roller area, said auxiliary air duct opening admitting an auxiliary flow of air into said dirt removal conduit for air flow towards said opening roller area.

2. An open-end spinning frame in accordance with claim 1, wherein said auxiliary air duct admits an auxiliary flow of air into said dirt removal conduit for air flow both towards said opening roller area and away from said opening roller area.

3. An open-end spinning frame according to claim 1, wherein said auxiliary air duct opens into said dirt removal conduit from said opening of said dirt removal conduit into said opening roller area by approximately one-fourth to approximately one-third of the total length of said dirt removal conduit.

4. An open-end spinning frame according to claim 1, wherein said dirt removal conduit and said auxiliary air duct are arranged to be operative to divide an air flow upon entry into said dirt removal conduit from said auxiliary air duct into a first air flow through said dirt removal conduit toward said opening roller area and a second opposite air flow through said dirt removal conduit away from said opening roller area.

5. An open-end spinning frame according to claim 1, wherein said dirt removal conduit is defined entirely by a wall of said housing.

6. An open-end spinning frame according to claim 1, further comprising a second auxiliary air duct opening into said dirt removal conduit, at least one of said auxiliary air flow ducts being defined entirely by a wall of said housing.

7. An open-end spinning frame in accordance with claim 6, where at least one said auxiliary air duct communicates with ambient air.

8. An open-end spinning frame in accordance with claim 1, wherein said dirt fallout chamber communicates with ambient air.

9. An open-end spinning frame in accordance with claim 8, wherein said auxiliary air flow duct communicates with ambient air.

10. An open-end spinning frame in accordance with claim 9, wherein said dirt removal conduit communicates with ambient air.

* * * * *